US006554885B1

(12) United States Patent
Mende et al.

(10) Patent No.: US 6,554,885 B1
(45) Date of Patent: Apr. 29, 2003

(54) PRE-ALLOYED POWDER

(75) Inventors: Bernd Mende, Bad Harzburg (DE); Gerhard Gille, Goslar (DE); Benno Gries, Wolfenbüttel (DE); Peter Aulich, Goslar (DE); Jörg Münchow, Hahausen (DE)

(73) Assignee: H. C. Starck GmbH, Goslar (DE)

( * ) Notice: Subject to any disclaimer, the term of this patent is extended or adjusted under 35 U.S.C. 154(b) by 0 days.

(21) Appl. No.: 09/700,533

(22) PCT Filed: May 8, 1999

(86) PCT No.: PCT/EP99/03170

§ 371 (c)(1),
(2), (4) Date: Nov. 15, 2000

(87) PCT Pub. No.: WO99/59755

PCT Pub. Date: Nov. 25, 1999

(30) Foreign Application Priority Data

May 29, 1998 (DE) ..... 198 22 663

(51) Int. Cl.[7] ..... B22F 9/24

(52) U.S. Cl. ..... 75/365; 75/369; 75/371; 75/373; 75/374

(58) Field of Search ..... 75/348, 365, 369, 75/371, 373, 374

(56) References Cited

U.S. PATENT DOCUMENTS

| | | | | |
|---|---|---|---|---|
| 3,855,016 A | * | 12/1974 | Ehrreich et al. | 75/348 |
| 3,923,496 A | * | 12/1975 | Pall | 75/365 |
| 4,803,291 A | * | 2/1989 | Rousset et al. | 75/348 |
| 5,925,166 A | | 7/1999 | Viau et al. | 75/369 |
| 6,346,137 B1 | * | 2/2002 | Hohne et al. | 75/369 |

FOREIGN PATENT DOCUMENTS

| | | |
|---|---|---|
| EP | 0 326 861 | 8/1989 |
| EP | 0 770 693 | 5/1997 |
| GB | 419 953 | 11/1934 |
| GB | 610 514 | 10/1948 |
| WO | 92/18656 | 10/1992 |
| WO | 97/21844 | 6/1997 |
| WO | 98/49361 | 11/1998 |

OTHER PUBLICATIONS

Metall, 40, Feb. 1986, pp. 133–140, Grewe et al, Cobalt–Substitution in technischen Hartmetallen.

Int. J. of Refractory Metals & Hard Materials, 15 (month unavailable) 1997, pp. 139–149, Björn Uhrenius et al, On the Composition of Fe–Ni–Co–WC–Based Cemented Carbides.

*Hickling H. and D.S. Coleman: "Sintering of fine iron powders produced from ferrous oxalate dihydrate", Powder Metallurgy, vol. 25, No. 1, pp. 25–34, XP002113328.

*Carman E.H. et al: "A Method of Preparing Iron Powder for Permanent Magnets", Metallurgia the British Journal of Metals, vol. 52, No. 312, Oct. 1955, pp. 165–168, XP002113485.

* cited by examiner

*Primary Examiner*—George Wyszomierski
(74) *Attorney, Agent, or Firm*—Godfried R. Akorli; Diderico van Eyl; John E. Mrozinski, Jr.

(57) ABSTRACT

A process is described for the production of metal powder and alloy powders containing at least one of the metals iron, copper, tin, cobalt or nickel, by mixing aqueous metal salt solutions with an aqueous carboxylic acid solution, separating the precipitation product from the mother liquor and reducing the precipitation product to the metal.

8 Claims, No Drawings

PRE-ALLOYED POWDER

FIELD OF THE INVENTION

The present invention relates to metal powders consisting of one or more of the elements Fe, Ni, Co, Cu, Sn and optional, in small amounts of Al, Cr, Mn, Mo, W, a process for their production as well as their use.

BACKGROUND OF THE INVENTION

Alloy powders have a variety of applications in the production of sintered materials by powder metallurgy. The main feature of powder metallurgy is that appropriate metal powders and alloy powders are compacted and then sintered at elevated temperature. This method has been introduced on the industrial scale for the production of complicated articles which otherwise cannot or can be produced only with a large degree of expensive finishing. The sintering can be a solid state sintering or by forming a liquid phase, as, for example, of hard metals or heavy metals. A very important application of alloy and pure metal powders is as tools for cutting and working metal, stone and wood. In these cases they are two-phase materials, wherein the hard constituent (for example, carbides or diamonds) is embedded in a metallic matrix, which is responsible for the required strength and toughness properties of these composites. The hard metals (in the case of carbides or carbonitrides) or diamond tools (in the case of diamonds) thus produced are of considerable economic importance.

The element cobalt is especially important, because it has some distinctive and unique properties as a metallic matrix in diamond and hard metal tools. Because it wets tungsten carbide and diamonds particularly well, traditionally it is preferably used for both types of tools. Through the use of cobalt for the metallic binder phase in composites based on tungsten carbide or diamond, a particularly good adhesion of the hardening constituent in the metallic binder phase is achieved. Also important is the fact that, in the case of cobalt, the tendency towards the formation of carbides of the type Co3W3C ("eta phases"), which lead to embrittlement in hard metals, is less distinct than, for example, in the case of iron. Moreover, diamonds are attacked by Co less, for example, than by iron, which easily forms $Fe_3C$. For these technical reasons, cobalt is traditionally used in the hard metal and diamond tool industry.

For the production of hard metals, one normally starts from cobalt metal powders of 0.8 to 2 $\mu$m FSSS (ASTM B 330), which, together with the hard materials, compressing aids and a grinding liquid, are subjected to a mixed grinding in attritors or ball mills, which contain balls of hard metal as grinding media. The suspension obtained is then separated from the grinding media, spray-dried, and the granular material obtained is pressed into moulds. The subsequent liquid-phase sintering at temperatures above the melting point of the W—Co—C eutectic mixture produces dense sintered bodies (hard metals). An important property of the hard metals thus produced is their strength, which is weakened by porosity. Industrial hard metals have a porosity of better than or equal to A02B00C00 in accordance with ASTM B 276 (or DIN ISO 4505). The microporosity is referred to as A porosity, whereas B porosity denotes the macroporosity. Unlike hard materials, cobalt metal powders are ductile, and during the mixed grinding the particles will be plastically deformed and agglomerated particles will be deagglomerated. If the cobalt metal powders used contain large, compactly sintered agglomerates, these are transferred in deformed form into the spray-dried granular material and produce A and B porosity in the sintered hard metal, frequently associated with local concentration of the binder phase, the so called binder lakes.

Diamond tools, as the second important group used, contain as cutting or grinding components sintered parts (segments), which consist mainly of diamonds embedded in a metallic binder phase, mainly cobalt. Besides that, optionally further hard materials or other metal powders are added in order to match the wear properties of the binder to the diamonds and to the materials to be worked. To prepare the segments, metal powder, diamonds and optionally hard material powder are mixed together, optionally granulated and densely sintered in hot presses at increased pressure and elevated temperature. The requirements placed on the binder metal powders, apart from the necessary chemical purity, are: good compressibility, a high sintering activity, a hardness which is matched to the diamonds and to the medium to be worked, adjusted via the particle size or grain size after sintering, as well as low attack on the diamonds, which are metastable at the sintering temperature (graphitisation).

The porosity generally decreases with increasing sintering temperature, that is, the density of the sintered part approaches its theoretical value for high enough temperatures. For reasons of strength, the sintering temperature chosen is therefore as high as possible. On the other hand, however, the hardness of the metallic matrix decreases again above an optimal temperature, as coarsening of the grains takes place. In addition, it should be taken into account that at elevated temperature there is an increased attack on the diamonds. For these reasons, preferred binder powders for segments are those which attain their theoretical density at the lowest possible sintering temperatures and can be easily compacted.

The only limited availability of cobalt, the great price variations, the environmental aspects and the desire for technical improvement have led to numerous efforts to replace cobalt in the hard metal and diamond tool industry.

Thus there have already been a number of proposals to replace cobalt at least partially by iron and/or nickel or their alloys as binder metal (Metall, 40, (1986), 133 to 140); Int. J. of Refractory Metals & Hard Materials 15 (1997), 139 to 149).

A disadvantage in manufacturing of diamond tools by using metal powders of single elements and of bronze powders is that the metallic composition, distribution and bonding is very inhomogeneous after sintering, as the sintering temperature and sintering time are insufficient to achieve homogenisation. Moreover, where commercially available iron metal powders are used, there arise high forces and pressures due to the worse compactibility of these powders which wear out the pressing tools and lead to green compacts having low strengths (for example, breaking off of the edges). This can mainly be attributed to the body-centred cubic lattice type of the iron, which has fewer gliding planes than do the face-centred cubic types of the cobalt and nickel or copper metal powders. In addition, the finer carbonyl iron powders available contain high quantities of carbon, which can lead to loss in strength in the segments. Atomised metal powders or alloys have insufficient sintering activity, so that compaction is still insufficient at temperatures justifiable for the diamonds. In the manufacture of hard metals by carbonyl iron powder there are problems regarding distribution of the binder (A- and/or B-porosity). This can be compensated by a more intensive milling, resulting, however, in widening of grain size distribution.

Thus there have also been a number of proposals to produce metallic alloy powders by precipitation, partially in the presence of organic phases, and subsequent reduction (WO 92/18 656, WO 96/04 088, WO 97/21 844).

The object of the invention is to provide metal powders and alloy powders containing at least one of the metals iron, copper, tin, cobalt or nickel, which meet the above-mentioned requirements placed on binder metals for hard metals and diamond tools.

The metal and alloy powders according to the object of the invention can be doped by small amounts of the elements Al, Cr, Mn, Mo and W and in such a way be modified and be suited to special requirements.

DESCRIPTION OF THE INVENTION

This invention provides, first of all, a process for the production of metal powders and alloy powders by mixing aqueous metal salt solutions with a carboxylic acid solution, separating the precipitation product from the mother liquor and reducing the precipitation product to the metal, which is characterised in that the carboxylic acid is used in hyperstoichiometric quantity and as concentrated aqueous solution.

After separation from the mother liquor, the precipitation product is preferably washed with water and dried.

The precipitation product is reduced preferably in an atmosphere containing hydrogen, at temperatures between 400° C. and 600° C. The reduction can be carried out in an indirectly heated rotary kiln or in a pusher type kiln. Other possible ways of carrying out the reduction, for example, in a double-deck oven or in a fluidised bed, are readily familiar to the person skilled in the art.

In one embodiment, prior to the reduction of the precipitation product to a metallic alloy powder, the precipitation product is subjected to a thermal decomposition at 200° C. to 1000° C. in an oxygen-containing atmosphere.

In a preferred embodiment of the invention, prior to the reduction the dried precipitation product is calcined in an oxygen-containing atmosphere at temperatures between 250° C. and 500° C. Firstly, the calcination causes the precipitation product, which consists of polycrystalline particles or agglomerates, to be comminuted through decrepitation by means of the gases released during decomposition of the remains of the carboxylic acid. Therefore a larger surface is available for the subsequent gas phase reaction (reduction) and a finer end product is obtained. Secondly, the calcination in an oxygen-containing atmosphere brings about the production of a metal powder or alloy powder which has a considerably decreased porosity compared with that obtained in the direct reduction. During the conversion of the (mixed) metal carbonate salt to the metal powder or alloy powder, there is in fact a considerable shrinkage of the particles, which results in the inclusion of the pores. Through the intermediate calcination step in an oxygen-containing atmosphere, the (mixed) metal carboxylic salt is first of all converted into the (mixed) metal oxide and tempered, so that a prior compaction with an annealing of lattice vacancies takes place. During the subsequent reduction in a hydrogen containing atmosphere, accordingly only the volume shrinkage of the oxide to the metal has still to be achieved. Through the intermediate calcination step a gradual volume shrinkage is achieved, with structural stabilisation of the crystals after each shrinkage step.

Suitable carboxylic acids are aliphatic or aromatic, saturated or unsaturated mono- or dicarboxylic acids, in particular those having 1 to 8 carbon atoms. Because of their reducing action, preferably formic acid, oxalic acid, acrylic acid and crotonic acid are used. Formic acid and oxalic acid in particular are used because of their availability; oxalic acid is particularly preferred. The excess reducing carboxylic acid prevents the formation of Fe(III) ions, which would give rise to problems during the precipitation.

The carboxylic acid is used preferably in a 1.1- to 1.6-times stoichiometric excess, with reference to the metals. A 1.2- to 1.5-times excess is particularly preferred.

In another preferred embodiment of the invention, the carboxylic acid solution is used in the form of a suspension containing the suspended undissolved carboxylic acid. The carboxylic acid suspension preferably used contains a depot of undissolved carboxylic acid, from which carboxylic acid withdrawn from the solution by precipitation is replaced, so that throughout the precipitation reaction a high concentration of carboxylic acid is maintained in the mother liquor. The concentration of dissolved carboxylic acid in the mother liquor at the end of the precipitation reaction should preferably still be at least 20% of the saturation concentration of the carboxylic acid in water. At the end of the precipitation reaction the concentration of dissolved carboxylic acid in the mother liquor should more preferably still be 25 to 50% of the saturation concentration of the carboxylic acid in water.

A chloride solution is preferably used as the metal salt solution. The concentration of the metal salt solution is preferably about 1.6 to 2.5 mol per liter. The metal salt solution has an iron content preferably of 10 to 90 wt. %, based on the total metal content, and at least one other of the elements copper, tin, nickel or cobalt. The iron content of the metal salt solution is in particular preferably at least 20 wt. %, more preferably more than 25 wt. %, and most preferred at least 40 wt. %, however, less than 80 wt. %, more preferred less than 60 wt. %, in each case based on the total metal content.

The metal salt solutions preferably also contain 10 to 70 wt. % cobalt, particularly preferred up to 45 wt. %, based on the total metal content. The nickel content of the metal salt solution is preferably 0 to 50 wt. %, particularly preferred up to 16 wt. % Copper and/or tin can be used in quantities of up to 30 wt. %, preferably up to 10 wt. %, based on the total metal content. In the particularly preferred embodiment of the process according to the invention, the metal salt solution is added gradually to the carboxylic acid suspension, in such a way that the concentration of dissolved carboxylic acid in the mother liquor during the introduction of the metal salt solution does not exceed a value of 50% of the solubility of carboxylic acid in water. Particularly preferably, the metal salt solution is added so gradually, that up to the point at which the suspended carboxylic acid is dissolved, the concentration of dissolved carboxylic acid does not fall below 80% of the solubility in water. The rate of addition of the metal salt solution to the carboxylic acid suspension is therefore such that the withdrawal of carboxylic acid from the mother liquor, inclusive of lowering of concentration through dilution by the water introduced with the metal salt solution, is largely compensated for by the dissolving of undissolved, suspended carboxylic acid.

With regard to the precipitation of the metal salts, a concentrated carboxylic acid solution has an "activity 1"; an only semi-concentrated carboxylic acid solution has an "activity 0.5". According to the invention, the activity of the mother liquor accordingly is preferably not to fall below 0.8 during the addition of the metal salt solution.

By way of example, the solubility of the preferably used oxalic acid in water is approximately 1 mol per liter water (room temperature), accordingly 126 g oxalic acid (2 molecules water of crystallisation). In the preferred process according to the invention, the oxalic acid is to be introduced as an aqueous suspension containing 2.3 to 4.5 mol oxalic acid per liter water. This suspension contains approximately 1.3 to 3.5 mol undissolved oxalic acid per liter water. After introduction of the metal salt solution and conclusion of precipitation, the concentration of oxalic acid in the mother liquor is still to be 20 to 55 g/l water. During the introduction of the metal salt solution into the oxalic acid suspension, the oxalic acid used up in the precipitation is constantly replaced by the dissolving of suspended oxalic acid. The mother liquor is constantly stirred in order to achieve homogenisation. In the preferred embodiment, the metal salt solution is added so gradually, that the oxalic acid concentration in the mother liquor during the addition does not fall below 75 g, particularly preferably not below 100 g, per liter of mother liquor. The result of doing this is that during the addition of the metal salt solution, a sufficiently high supersaturation, which is adequate for the formation of nuclei, that is, for the production of further precipitated particles, is consistently attained. By this means, on the one hand a high nucleation rate, which correspondingly leads only to small particles, is ensured and on the other hand, owing to the low concentration of metal ions present in the mother liquor, an agglomeration of particles owing to partial solution is largely prevented.

During the precipitation, the preferred high carboxylic acid concentration according to the invention also causes the precipitation product to have the same composition, with regard to the relative contents of the metals, as the metal salt solution; that is, a precipitation product, and hence metal alloy powder, is formed which is homogeneous as regards its composition.

The invention also provides metal powders and alloy powders which contain at least one of the elements iron, copper, tin, nickel or cobalt and which can be doped in secondary amounts by one or more of the elements Al, Cr, Mn, Mo, W, and have an average particle size according to ASTM B 330 (FSSS) of from 0.5 to 7 $\mu$m, preferably below 3 $\mu$m. The alloy powders according to the invention are characterised in that they have no fractured surfaces caused by grinding. They are available in this particle size range immediately after the reduction without any milling procedure. Preferred metal particles or alloy particles according to the invention have a very low carbon content, less than 0.04 wt. %, preferably less than 0.01 wt. %. This can be attributed to the temperature treatment in an oxygen-containing atmosphere carried out between precipitation and reduction, during which the organic carbon present after the precipitation is removed. Preferred metal powders or alloy powders according to the invention also have an oxygen content of less than 1 wt. %, preferably less than 0.5 wt. %. The preferred composition of the alloy powders according to the invention corresponds to the preferred relative metal contents of the metal salt solutions used, as stated above. The metal powders and alloy powders according to the invention are eminently suitable as binder metal for hard metals or diamond tools. They are also suitable for construction and wear parts made by powder metallurgy.

In the manufacturing of hard metals the metal powders and alloy powders according to the present invention show higher sintering activity, more complete forming of alloys and better wetting of hard constituents, thus leading to hard metals free of porosity.

The metal powders and alloy powders according to the present invention are furtheron unique in that they can be sintered to particularly dense sintered bodies at comparatively low temperature.

An object of the invention accordingly are also metal powders or alloy powders which after sintering at 650° C. under a compacting pressure of 35 MPa during a time of 3 minutes form sintered bodies having more than 96%, preferably more than 97%, of the theoretical density of the material. Particularly preferred alloy powders reach a density of more than 97% of the theoretical density of the material already at a sintering temperature of 620° C. "Theoretical density of the material"shall mean the density of an alloy of corresponding composition obtained from melting under vacuum.

The invention is illustrated in more detail below by means of the attached Examples 1 to 7.

EXAMPLES 1 TO 4

In each Example, 6.3 l of a metal chloride solution containing 75 g/l Fe, 15 g/l Ni and 10 g/l Co was introduced gradually, with stirring, into a suspension of 1954 g oxalic acid (the 1.4 times stoichiometric quantity, based on the metal salts) in the quantity of water given in Table 1. After precipitation had finished, the mixture was stirred for a further 30 minutes; the precipitate was then filtered off and washed with water. The oxalate was dried to constant weight at 105° C. The particle sizes (FSSS) of the dried mixed oxalate are given in Table 1. The mixed oxalate was then calcined in a muffle furnace for 3 hours at 300° C. and then reduced to the metal alloy powder under hydrogen at 500° C. in a sliding-batt kiln.

27 g portions of the mixed-metal powder were ground in an attritor under hexane together with 273 g WC (Grade DS80 containing 0.15% VC, manufacturer HCSt, Goslar), with addition of 0.3 g carbon black. After the grinding balls had been removed and the ground material dried, a green compact was produced and sintered by means of a compacting pressure of 1500 kg/cm$^3$ as follows: 20° C./min to 1100° C., holding at this temperature for 60 minutes, further heating at a rate of 20° C./min to 1400° C., holding at this temperature for 45 minutes, cooling to 1100° C., holding at this temperature for 60 minutes and cooling to room temperature. The sintered compact had the properties given in Table 1.

TABLE 1

| | Example | | | |
|---|---|---|---|---|
| | 1 | 2 | 3 | 4 |
| Quantity of water Oxalic acid suspension (1) | 15.6* | 7.8 | 5.9 | 3.9 |
| Particle size of mixed oxalate ($\mu$m, FSSS) | 25.7 | 21.0 | 11.5 | 7.6 |
| Metal alloy powder: | | | | |
| Particle size ($\mu$m, FSSS) | 2.1** | 1.73 | 0.72 | 0.7 |

TABLE 1-continued

| | Example | | | |
|---|---|---|---|---|
| | 1 | 2 | 3 | 4 |
| Physical density ($g/cm^3$) | 6.49 | 7.51 | 7.53 | 7.53 |
| Bulk density ($g/cm^3$) | 0.44 | 0.38 | 0.26 | 0.24 |
| Oxygen content (wt. %) | 0.96 | 0.81 | 0.69 | 0.70 |
| Sintered compact: | | | | |
| Density ($g/cm^3$) | 14.36 | 14.38 | 14.43 | 14.41 |
| Vickers hardness $HV_{30}$ ($kg/mm^2$) | 1785 | 1797 | 1814 | 1812 |
| Porosity ASTM B 276 | A04B02C00 | A04B00C00 | <A02B00C00 | <A02B00C00 |

*clear solution
**uneven particle size distribution

EXAMPLE 5

39 l of a metal chloride solution containing 50 g/l Fe, 42.3 g/l Co and 7.7 g/l Ni was introduced at room temperature, over a period of 30 minutes, with constant stirring, into a suspension of 12.877 kg oxalic acid in 45 l water and stirring was then continued for a further 60 minutes. This was followed by filtration and washing and the oxalate was dried to constant weight at 110° C. The oxalate was calcined in a muffle furnace for 3 hours at 300° C. and the oxide thus produced was subsequently reduced to metal powder under hydrogen (dew point 10° C.) in a sliding-batt kiln in three consecutive heating zones at 480/500/530° C. over a total period of 130 minutes. Measurements on the metal powder showed an FSSS value of 0.71 $\mu$m, a physical density of 7.76 $g/cm^3$ and a bulk density of 0.24 $g/cm^3$; the oxygen content was found to be 0.71%.

A hard metal test was carried out on this metal powder, under conditions identical to those in Examples 1 to 4. Measurements on the test specimen showed a density of 14.54 $g/cm^3$, a Vickers hardness $HV_{30}$=1817 $kg/mm^2$ and a porosity of <A02B00C00 in accordance with ASTM B 276 (no visible microporosity under the light microscope at 200 times magnification).

EXAMPLE 6

The oxalate precipitation was carried out as in Example 5, but a chloride solution containing 42.7 g/l Co and 56.3 g/l Fe was used.

The calcination in the muffle furnace was carried out at 250° C. The three-step reduction under hydrogen was carried out at 520/550/570° C.

25 g portions of this Fe—Co alloy powder were sintered at different temperatures in a graphite matrix in a vacuum (hot press, product of the firm Dr. Fritsch, type TSP) at a compacting pressure of 35 MPa for a compacting time of 3 minutes.

The results which were obtained are shown in Table 2.

TABLE 2

| Sintering temperature ° C. | Hardness Rockwell B | Sintered density $g/cm^3$ | % of theoretical density* |
|---|---|---|---|
| 580 | 116.9 | 7.87 | 93.98 |
| 620 | 116.3 | 8.07 | 96.37 |
| 660 | 113.5 | 8.15 | 97.32 |
| 700 | 109.4 | 8.16 | 97.44 |
| 740 | 109.5 | 8.16 | 97.44 |
| 780 | 110.1 | 8.11 | 96.84 |
| 820 | 109.4 | 8.16 | 97.44 |
| 860 | 109.7 | 8.10 | 96.72 |

*Theoretical density = average value of the densities of Co and Fe corresponding to their percentages = 8.37 $g/cm^3$

EXAMPLE 7

Analogous to Example 1 an iron/cobalt copper oxalate is prepared by precipitation, washing and drying by use of a metal chloride solution containing 45 g/l Fe, 45 g/l Co, and 10 g/l Cu.

One part (part A) of the mixed metal oxalate is reduced directly in a stream of hydrogen at 520° C. over 6 hours.

Another part (part B) of the mixed metal oxalate is first treated under atmospheric air at 300° C. over 3 hours and thereafter reduced in a stream of hydrogen at 520° C. over 130 minutes. Properties of the metal powders obtained are shown in Table 3.

TABLE 3

| Example | 7A | 7B |
|---|---|---|
| particle size FS 55 $\mu$m | 4.67 | 4.8 |
| Mastersizer | | |
| D 10 $\mu$m | 12.91 | 14.43 |
| D 50 $\mu$m | 35.23 | 36.72 |
| D 90 $\mu$m | 430.22 | 419.9 |
| Density $g/cm^3$ | 7.91 | 8.04 |
| $O_2$-content ppm | 3210 | 2100 |
| C-content ppm | 200 | 50 |

Hot press tests are carried as described in Example 6. The results are shown in Table 4 (HRB=Hardness Rockwell B; SD=sintering density $g/cm^3$; % TD=% of theoretical density):

TABLE 4

| Sintering Temperature | Example 7A | | | Example 7B | | |
|---|---|---|---|---|---|---|
| ° C. | HRB | SD | % TD | HRB | SD | % TD |
| 580 | 105.8 | 7.55 | 88.95 | 110.9 | 7.92 | 93.83 |
| 620 | 111.1 | 8.05 | 94.84 | 111.3 | 8.22 | 97.38 |
| 660 | 111.2 | 8.19 | 96.49 | 110.6 | 8.22 | 97.38 |
| 700 | 110.6 | 8.19 | 96.49 | 109.8 | 8.22 | 97.38 |
| 740 | 109.6 | 8.20 | 96.6 | 107.5 | 8.22 | 97.38 |
| 780 | 109.6 | 8.19 | 96.49 | 108.6 | 8.24 | 97.62 |
| 820 | 108.6 | 8.18 | 96.37 | 104.4 | 8.24 | 97.62 |
| 860 | 106.6 | 8.20 | 96.60 | 106.2 | 8.23 | 97.5 |

Although the present invention has been described in detail with reference to certain preferred versions thereof, other variations are possible. Therefore, the spirit and scope of the appended claims should not be limited to the description of the versions contained therein.

What is claimed is:

1. A process for producing a metal powder or an alloy powder containing at least one metal selected from the group consisting of iron, copper, tin, cobalt and nickel, comprising:

mixing an aqueous metal salt solution with a saturated aqueous carboxylic acid solution in a mother liquor and forming a precipitation product;

separating the precipitation product from the mother liquor; and reducing the precipitation product to the metal or alloy powder, wherein the aqueous carboxylic acid solution contains solid carboxylic acid in a quantity sufficient that the mother liquor, after precipitation has finished, is still at least 10% saturated, based on an aqueous solution free of metal salt.

2. The process of claim 1, wherein prior to the reduction to the powder, the precipitation product is subjected to a thermal decomposition at 200° C. to 1000° C. in an oxygen-containing atmosphere.

3. The process of claim 1, wherein the reduction of the precipitation product to the metal or alloy powder is carried out at a temperature of from about 400 to about 600° C.

4. The process of claim 1, wherein the reduction of the precipitation product to the metal or alloy powder is carried out at a temperature of from about 250 to about 500° C.

5. The process of claim 1, wherein the metal salt solution is introduced into the prepared aqueous carboxylic acid solution.

6. The process of claim 1, wherein the aqueous metal salt solution and carboxylic acid solution are introduced continuously into a precipitation reactor and a mother liquor containing the precipitation product is continuously withdrawn.

7. A process for producing a metal powder or an alloy powder containing at least one metal selected from the group consisting of iron, copper, tin, cobalt and nickel, comprising:

mixing an aqueous metal salt solution with a saturated aqueous carboxylic acid solution in a mother liquor and forming a precipitation product;

separating the precipitation product from the mother liquor; and reducing the precipitation product to the metal or alloy powder, wherein the aqueous carboxylic acid solution contains solid carboxylic acid in a quantity sufficient that the mother liquor, after precipitation has finished, is more than 20% saturated, based on an aqueous solution free of metal salt.

8. A process for producing a metal powder or an alloy powder containing at least one metal selected from the group consisting of iron, copper, tin, cobalt and nickel, comprising:

mixing an aqueous metal salt solution with a saturated aqueous carboxylic acid solution in a mother liquor and forming a precipitation product;

separating the precipitation product from the mother liquor; and reducing the precipitation product to the metal or alloy powder, wherein the aqueous carboxylic acid solution contains solid carboxylic acid in a quantity sufficient that the mother liquor, after precipitation has finished, is more than 25% saturated, based on an aqueous solution free of metal salt.

* * * * *